US005582581A

United States Patent [19]

Horton

[11] Patent Number: 5,582,581

[45] Date of Patent: Dec. 10, 1996

[54] MASSAGE SOAP BAR APPARATUS

[76] Inventor: Azor Horton, 23766 Crisler, Taylor, Mich. 48180

[21] Appl. No.: 394,811

[22] Filed: Feb. 27, 1995

[51] Int. Cl.[6] ..... A61H 1/00; A61H 11/00

[52] U.S. Cl. ..... 601/70; 601/72; 401/52; 401/88

[58] Field of Search ..... 252/174, 92, 90; D28/8.1; D6/532, 533, 536; 248/686, 223.4, 221.3; 206/77.1; 401/6, 88, 52; 601/67–74

[56] References Cited

U.S. PATENT DOCUMENTS

| | | | |
|---|---|---|---|
| D. 27,959 | 12/1897 | Curtin | D28/8.1 |
| D. 46,240 | 8/1914 | Williams . | |
| 1,478,392 | 12/1923 | Kearney . | |
| 2,007,107 | 7/1935 | Bottrill . | |
| 2,099,484 | 11/1937 | Hokerk | 401/131 |
| 2,226,898 | 12/1940 | Clouthier | 401/18 |
| 3,100,363 | 8/1963 | Staver | 401/6 |
| 3,585,990 | 6/1971 | Blachly . | |
| 3,943,921 | 3/1976 | Colk | 601/73 |
| 4,618,443 | 10/1986 | Jude | 401/6 |
| 4,621,934 | 11/1986 | Starek | 401/18 X |
| 4,696,068 | 9/1987 | Kenner . | |
| 4,861,505 | 8/1989 | Farman | 252/174 X |
| 5,031,759 | 7/1991 | Ogilvie | 206/77.1 |
| 5,033,613 | 7/1991 | Liggett | 206/77.1 |
| 5,125,398 | 6/1992 | Horton | 601/92 |

FOREIGN PATENT DOCUMENTS

| | | | |
|---|---|---|---|
| 2835458 | 2/1980 | Germany | 248/686 |
| 232377 | 5/1944 | Switzerland | 248/686 |

*Primary Examiner*—Robert A. Hafer
*Assistant Examiner*—Brian E. Hanlon
*Attorney, Agent, or Firm*—Richard C. Litman

[57] ABSTRACT

A massaging, cleansing apparatus comprises a vibratory massaging portion and a formed soap bar. The massaging portion is dimensioned and configured to releasably receive the soap bar. The apparatus provides a vibratory massage during use of the soap bar, and also allows for non-destructive changing of soap bars, replacement of used soap bars, and continued use of the massaging portion after depletion of the soap bar.

6 Claims, 3 Drawing Sheets

MASSAGE SOAP BAR APPARATUS

BACKGROUND OF THE INVENTION

1. Field of the Invention

The present invention relates generally to massaging and cleansing articles, and more specifically to implements combining both massaging and cleansing functions in one article.

2. Description of the Prior Art

It is desirably convenient to combine massaging and cleansing function in a single implement. In this way, time spent cleaning one's skin or face can also be used for obtaining a stress-relieving massage, without any extra time cost. The advantages of such a combination have long been recognized, and consequently there have been numerous attempts to create and improve on this combination. However, such prior efforts have failed to provide a device having a vibrating massager that can readily be attached to and detached from a soap bar. Such a device is needed because it allows re-use of the vibrating component when attached soap is depleted or must be replaced with soap of another type.

U.S. Pat. No. 1,478,392, issued on Dec. 25, 1923, to Dennis B. Kearney, describes a soap receptacle and brush combination. The invention does not provide a vibrating component or the slide-in means for attaching soap used in the present invention.

U.S. Pat. No. 2,007,107, issued on Jul. 2, 1935, to David Hugh Bottrill, describes a soap having massaging fingers projecting therefrom. The invention does not provide a vibrating component or the slide-in means for attaching soap used in the present invention.

U.S. Pat. No. 3,585,990, issued on Jun. 22, 1971, to Donald L. Blachly, describes a waterproof massaging apparatus without any provision for combined use with soap.

U.S. Pat. No. 3,943,921, issued on Mar. 16, 1976, to Carl F. G. Colk, describes an apparatus in which a sponge and soap bar are vibrated. Because of the configuration of the apparatus, with the soap located behind the sponge, the patent teaches away from the removability of the soap.

U.S. Pat. No. 4,696,068, issued on Sep. 29, 1987, to Mary B. Kenner, describes a device meant to wash and massage a person's back. The device is not meant to be hand-held, but rather is adhered to a flat surface using suction cups. The device does not provide any mechanism for vibratory action. Also, soap used with the device is held in a bag rather than in a fitted slot, so that removal is more complicated and the soap is not directly manipulatable while in the device.

U.S. Pat. No. 5,033,613, issued on Jul. 23, 1991, to James R. Liggett, describes a receptacle for a soap bar. The receptacle is intended to hold the soap while not in use. The bar cannot practically be used while it is in the receptacle. There is no showing of vibrational or other massaging function. There is a rope for use in closing the receptacle, but it is not attached to the soap while the soap is oriented for use.

U.S. Pat. No. 5,125,398, issued on Jun. 30, 1992, to Azor R. Horton, describes a combination soap and massage apparatus. Bristles and a vibrational mechanism are embedded in a soap bar. The invention is configured such that the soap cannot be removed from the vibratory mechanism without destruction.

U.S. Pat. No. Des. 46,240, issued on Aug. 4, 1914, to Bradford L. Williams, shows a hand-operated massage device. The invention does not provide a vibrating component or the slide-in means for attaching soap used in the present invention.

None of the above inventions and patents, taken either singly or in combination, is seen to describe the instant invention as claimed.

SUMMARY OF THE INVENTION

According to the present invention, a massaging, cleansing apparatus comprises a vibratory massaging portion and a formed soap bar. The massaging portion is dimensioned and configured to releasably receive the soap bar. The apparatus provides a vibratory massage during use of the soap bar, and also allows for non-destructive changing of soap bars, replacement of used soap bars, and continued use of the massaging apparatus despite depletion of the soap bar.

Accordingly, it is a principal object of the invention to provide a combination massage and cleansing article in which the massaging action is provided by a vibratory massager.

It is another object of the invention to allow use of the massaging portion of such a combination, even when the soap is depleted.

It is a further object of the invention to allow interchanging of soap bars in such a combination, in order to adapt the combination to special applications.

It is yet another object of the invention to save a user's time by allowing a user to obtain both a vibrating massage and cleansing by use of a single apparatus.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

Figure 1:
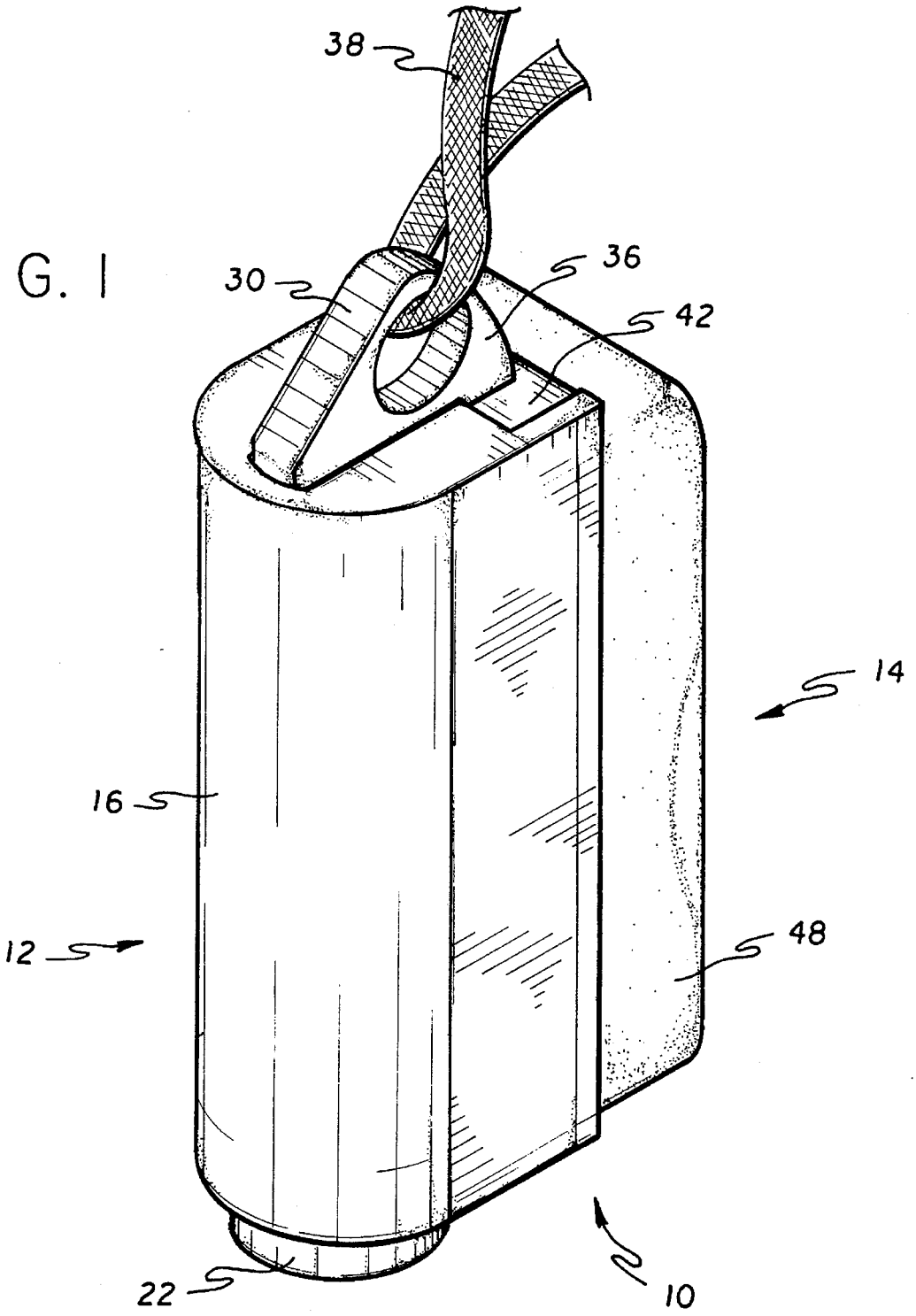
FIG. 1 is a perspective view of the soap and vibrator combination according to the present invention.
Figure 2:
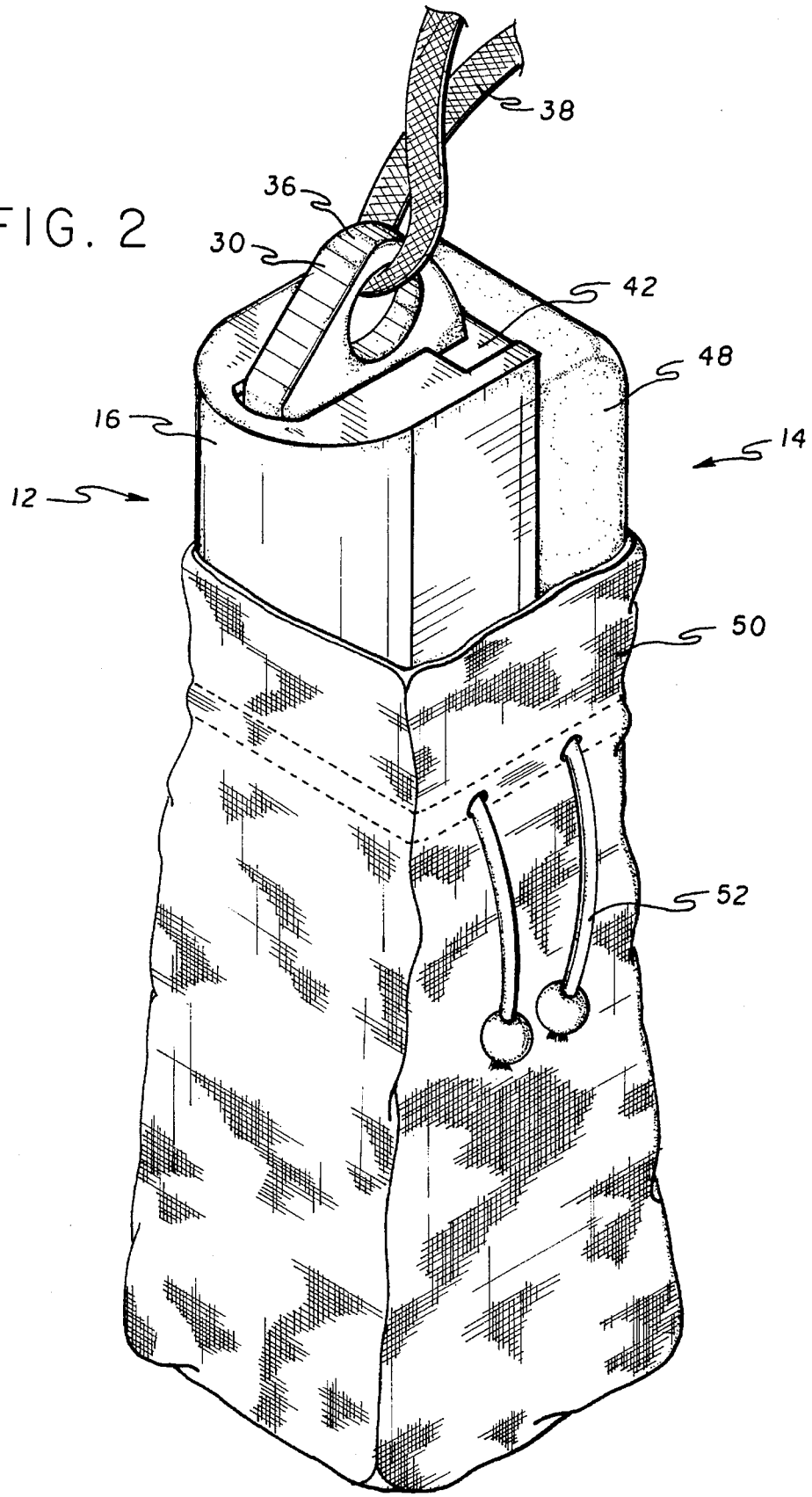
FIG. 2 is a perspective view of the present invention when partially inserted into a storage bag.
Figures 3, 3A:
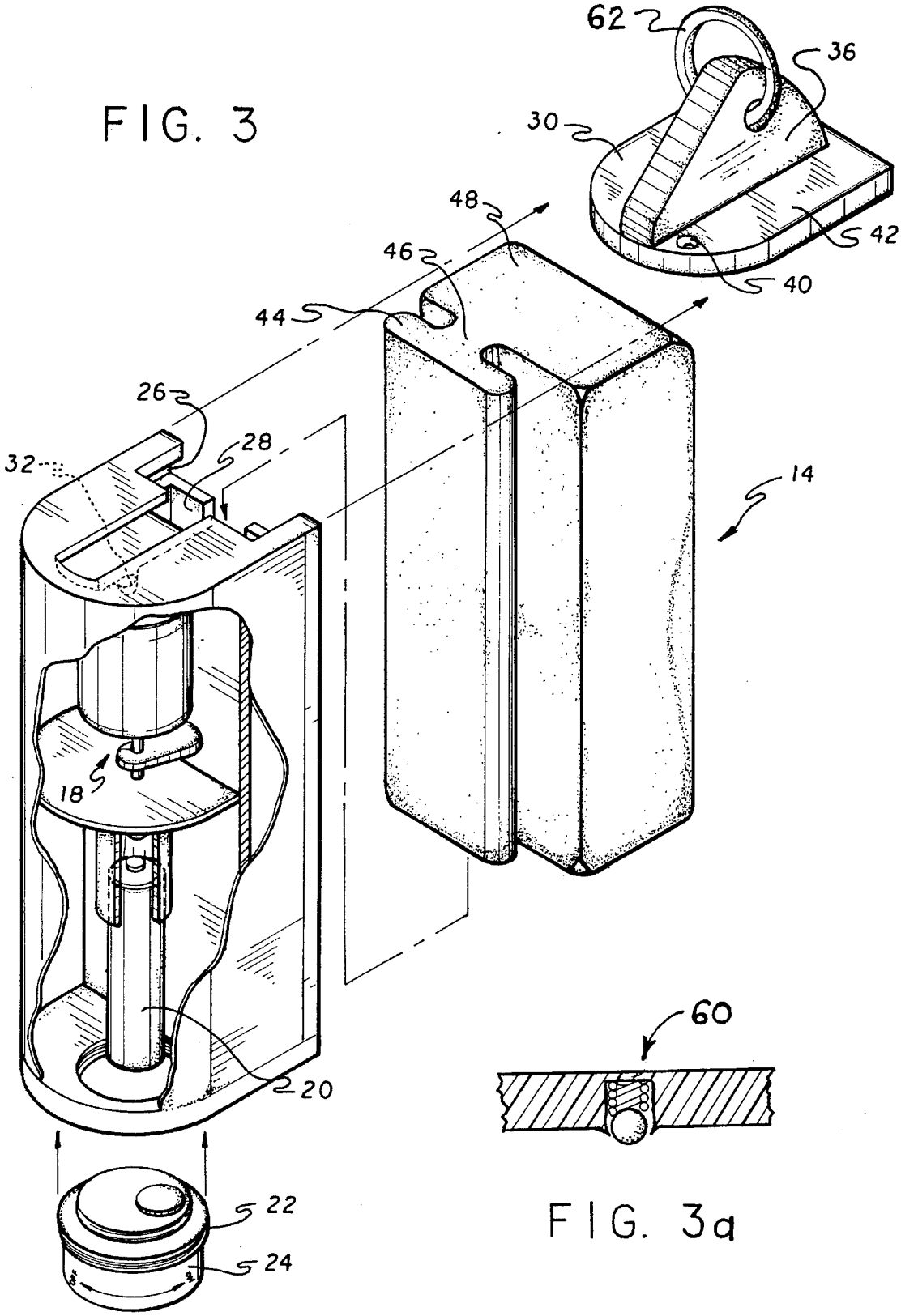
FIG. 3 is an exploded, cut-away view of the soap and vibrator combination.

FIG. **3*a* is a detail sectional view taken from the upper left hand corner of FIG. 3**.

Similar reference characters denote corresponding features consistently throughout the attached drawings.

DETAILED DESCRIPTION OF THE PREFERRED EMBODIMENT

According to the present invention, a massaging, cleansing apparatus comprises a vibratory massaging portion and a formed soap bar. The massaging portion is dimensioned and configured to releasably receive the soap bar. The apparatus provides a vibratory massage during use of the soap bar, and also allows for non-destructive changing of soap bars, replacement of used soap bars, and continued use of the massaging portion despite depletion of the soap bar.

Referring to the drawings, the massaging, cleansing apparatus of the present invention has a vibrating massager portion 12 and a formed soap bar 14. The massager portion 12 has a box-like container 16 for a vibrating mechanism 18 powered preferably by a dry-cell battery 20, which is also housed in the container 16. The battery 20 is retained by a releasably attached cap 22 on one end of the massager portion 12.

A variety of massaging mechanisms could be used in the massager portion 12 of the present invention, such as that described in U.S. Pat. No. 5,125,398, issued to Azor R. Horton on Jun. 30, 1992, which is incorporated herein by reference. The massaging mechanism 18 is controlled by a power control switch 24 disposed on the battery-retaining cap 22. The switch 24 can be rotated to turn the massaging mechanism 18 on or off.

The massager portion 12 also has two slots 26, 28. Each slot has inward projections so that each slot is C-shaped in cross section and is preferably open at a first end and closed at a second, opposing end. One slot 26 is dimensioned and configured to receive a soap-retaining clip 30. This slot 26 has a detent-like bump 32 located on an upper, internal surface of the slot 26. This bump 32 could be any known bump, such as a projection 32 integral with the upper, internal surface of the slot 26 or a springed ball 60. The other slot 28 is dimensioned and configured to receive the soap portion 14 of the apparatus 10.

The soap-retaining clip 30 has an integral apertured projection 36, or alternately an attached ring 62, through which a cord or rope 38 may be tied, or a hook inserted (not shown), as for holding or hanging the apparatus 10. The clip 30 also has a notch 40 on an upper surface 42 of the clip 30. When the clip 30 is fully inserted into the clip-receiving slot 26, the bump 32 engages the notch 40. This engagement releasably locks the clip 30 into the clip-receiving slot 26. In use, the retaining clip 30 is separated from the apparatus 10 and the soap portion 14 is placed in the soap-portion-receiving slot 28, if that slot 28 is empty, or removed if that slot 28 has soap in it.

The soap portion 14 of the apparatus 10 has a slot-engaging part 44 of intermediate width, a groove part 46 of narrowest width and a cleansing part 48 of greatest width. The slot-engaging part 44 and the cleansing part 48 are joined by the groove part 46. When inserted into the soap-portion-receiving slot 28, the slot-engaging part 44 is held within the slot 28. The cleansing part 48 protrudes and is exposed for use in cleaning.

To use the apparatus 10, the soap-portion 14 having a desired soap composition is placed in the soap-portion-receiving slot 28. The soap portion 14 may be wetted with water, as appropriate for the particular type of soap used. The soap-retaining clip 30 is then fully inserted into the soap-portion-receiving slot 26 to retain soap portion 14 in place. The massaging mechanism 18 is turned on and activated using the control switch 24, causing the massaging mechanism 18 to vibrate. The apparatus 10 is then used to provided both vibratory massaging and cleansing function simultaneously to skin, face, or wherever desired. At any time, the massaging mechanism 18 may be turned off and deactivated using the control switch 24. Also, the soap portion 14 may be changed to a soap portion 14 having a different type of soap, or if depleted, the soap portion 14 may be replaced with a new soap portion 14, without discarding the massager portion 12. Such changing and such replacement is accomplished by removing clip 30 from slot 26, removing the soap portion 14 from slot 28, and inserting another soap portion 14 into slot 28.

After or before use, the apparatus 10 can be stored in a releasably closable storage bag 50. The storage bag 50 can be closed through use of a drawstring 52. Preferably, the storage bag 50 is comprised by a water-proof material, and may have decorative features thereon (not shown).

It is to be understood that the present invention is not limited to the sole embodiment described above, but encompasses any and all embodiments within the scope of the following claims.

I claim:

1. A massaging and cleansing apparatus comprising:

a bar of soap having a cleaning portion, a groove portion, and a slot-engaging portion, said cleansing portion and said slot-engaging portion being joined by said groove portion;

a vibrating massaging portion having means for vibrating said massaging portion and a first slot with inward projections defining a C-shaped cross-section, said slot having a reversibly closable first end provided by a closure portion and a permanently closed second end, said slot and said projections being dimensioned and configured so that said bar of soap is slidably insertable into said slot with said groove portion engaging said projections;

said vibrating massaging portion having a second slot into which said closure portion is slidably insertable, said second slot being provided at said first end of said first slot and having a bump on an inner surface of said second slot;

said closure portion having a notch on an upper surface thereof, whereby when said closure portion is inserted into said second slot, said bump engages said notch, and said closure portion is releasably held in a fully inserted position that prevents release of said bar of soap from said first slot.

2. The massaging and cleansing apparatus according to claim 1, wherein said closure portion has an aperture through which a cord is tied.

3. The massaging and cleansing apparatus according to claim 1, further including a releasably closable bag dimensioned and configured to surround and enclose said bar of soap, said vibrating massaging portion and said closure portion when said massaging and cleansing apparatus is not in use.

4. The massaging and cleansing apparatus according to claim 3, wherein said bag is releasably closed by a drawstring.

5. A massaging and cleansing apparatus comprising:

a bar of soap having a cleaning portion, a groove portion, and a slot-engaging portion, said cleansing portion and said slot-engaging portion being joined by said groove portion;

a vibrating massaging portion having means for said massaging portion and a first slot with inward projections defining a C-shaped cross-section, said slot having a reversibly closable first end provided by a closure portion and a permanently closed second end, said slot and said projections being dimensioned and configured so that said bar of soap is slidably insertable into said slot with said groove portion engaging said projections;

said vibrating massaging portion having a second slot into which said closure portion is slidably insertable, said second slot being provided at said first end of said first slot and having a springed ball on an inner surface of said second slot;

said closure portion having a notch on an upper surface thereof, whereby when said closure portion is inserted into said second slot, said springed ball engages said notch, and said closure portion is releasably held in a fully inserted position that prevents release of said bar of soap from said first slot.

6. The massaging and cleansing apparatus according to claim 5, wherein said closure portion has a ring through which a cord can be tied.

* * * * *